US008752721B1

(12) United States Patent
Costanzo, Jr.

(10) Patent No.: US 8,752,721 B1
(45) **Date of Patent: *Jun. 17, 2014**

(54) ONE-PIECE FOLDABLE CORRUGATED COOLER WITH IMPROVED LOCKING SYSTEM

(71) Applicant: Thatbox Design, LLC, Fort Mill, SC (US)

(72) Inventor: Donn J. Costanzo, Jr., Fort Mill, SC (US)

(73) Assignee: Thatbox Design, LLC, Fort Mill, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/071,592

(22) Filed: Nov. 4, 2013

Related U.S. Application Data

(63) Continuation of application No. 13/420,393, filed on Mar. 14, 2012, now Pat. No. 8,573,430.

(60) Provisional application No. 61/452,640, filed on Mar. 14, 2011.

(51) Int. Cl.
*B65D 25/00* (2006.01)
*B65D 5/46* (2006.01)

(52) U.S. Cl.
USPC ..... 220/62; 206/459.5; 229/117.14

(58) Field of Classification Search
USPC ..... 229/117.12, 117.14, 117.3, 112, 229/117.15, 188, 115, 194, 114, 177, 229/117.05, 179; 493/162; 220/62
See application file for complete search history.

(56) References Cited

U.S. PATENT DOCUMENTS

| | | | | | |
|---|---|---|---|---|---|
| 4,238,069 | A * | 12/1980 | Morris, Jr. | ..... | 229/117.15 |
| 5,042,715 | A * | 8/1991 | McNeill | ..... | 229/117.15 |
| 5,284,294 | A * | 2/1994 | Floyd | ..... | 229/179 |
| 5,392,984 | A * | 2/1995 | Yocum | ..... | 229/117.15 |
| 5,853,121 | A * | 12/1998 | Francisco | ..... | 229/188 |
| 6,253,993 | B1 * | 7/2001 | Lloyd et al. | ..... | 229/117.3 |
| 6,736,309 | B1 * | 5/2004 | Westerman et al. | ..... | 229/117.05 |
| 6,837,420 | B2 * | 1/2005 | Westerman et al. | ..... | 229/117.15 |

* cited by examiner

*Primary Examiner* — Steven A. Reynolds
*Assistant Examiner* — Javier A Pagan
(74) *Attorney, Agent, or Firm* — Tillman Wright, PLLC; Chad D. Tillman; Jeremy C. Doerre

(57) ABSTRACT

A one-piece, foldable corrugated cooler includes a storage portion having a bottom panel, two side panels, two end panels, and four corner panels; two handle panels forming a lid and a handle; and at least one locking panel. The at least one locking panel is adapted to secure the lid in a closed orientation, and the at least one locking panel is integral with at least one corner panel and at least one handle panel.

20 Claims, 6 Drawing Sheets

ONE-PIECE FOLDABLE CORRUGATED COOLER WITH IMPROVED LOCKING SYSTEM

CROSS-REFERENCE TO RELATED APPLICATION

The present patent application is a continuation patent application of, and claims the benefit under U.S.C. §120 to, nonprovisional patent application Ser. No. 13/420,393 filed Mar. 14, 2012, which '393 application published as U.S. patent application publication no. US 2012/0234715, and which '393 application is a nonprovisional patent application of, and claims priority under 35 U.S.C. §119(e) to, U.S. provisional patent application Ser. No. 61/452,640, filed Mar. 14, 2011. Each of the foregoing priority applications are hereby incorporated by reference herein, and any patent application publications of, and patents issuing from, the foregoing priority documents are hereby incorporated by reference herein. Furthermore, the appendix hereto includes the disclosure of the '640 application relevant to the present application, which disclosure of the appendix is incorporated by reference herein. Additionally, U.S. nonprovisional patent application Ser. No. 13/049,890, and any publication thereof and any patent issuing there from, are hereby incorporated herein by reference.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to a cooler constructed from a single sheet of corrugated material. One-piece foldable coolers are well known in the art. U.S. Pat. No. 6,837,420 to Westerman et al. discloses a hand-held container for storing beverage containers formed by folding together multiple panels defined in a pre-scored, slotless blank. The container of Westerman includes two locking panels integral with only the end panels of the container for securing the top of the container in a closed orientation.

A need exists for improvement in one-piece foldable corrugated coolers. This, and other needs, are addressed by one or more aspects of the present invention.

SUMMARY OF THE INVENTION

The present invention includes many aspects and features. Moreover, while many aspects and features relate to, and are described in, the context of one-piece, foldable, corrugated coolers, the present invention is not limited to use only in one-piece, foldable, corrugated coolers, as will become apparent from the following summaries and detailed descriptions of aspects, features, and one or more embodiments of the present invention.

Accordingly, one aspect of the present invention relates to a one piece, foldable, corrugated cooler. An exemplary such cooler includes a storage portion with a bottom panel, two side panels, two end panels and four corner panels, two handle panels forming a lid and a two-ply handle, and at least one two-ply locking panel. The at least one two-ply locking panel is adapted to secure the lid in a closed orientation, and the at least one two-ply locking panel is integral with at least one corner panel and at least one handle panel.

In a feature of this aspect of the present invention, the handle includes a handle opening adapted to receive a user's hand there through. In a variation of this feature, the handle further includes a handle support tab.

In another feature, the handle includes at least one two-ply locking tab, and the at least one two-ply locking panel includes a slot there through adapted to receive and retain the at least one two-ply locking tab.

In still another feature, the cooler unfolds to a single flat sheet of corrugated material.

In yet another feature, interior walls of the storage portion include a moisture-resistant coating.

Another aspect of the present invention relates to a one-piece, foldable corrugated cooler. The cooler comprises a storage portion, including a bottom panel, two side panels, two end panels, and four corner panels. The cooler further includes two handle panels forming a lid and a two-ply handle, and at least one two-ply locking panel. The at least one two-ply locking panel is adapted to secure the lid in a closed orientation, and the at least one two-ply locking panel is integral with at least one corner panel and at least one handle panel.

In a feature of this aspect, the handle includes a handle opening adapted to receive a user's hand there through. In at least some implementations, the handle further includes a handle support tab.

In a feature of this aspect, the handle includes at least one two-ply locking tab, and the at least one two-ply locking panel includes a slot there through adapted to receive and retain the at least one two-ply locking tab. In at least some implementations, the cooler is configured to distribute weight away from the slot adapted to receive a locking tab. In at least some implementations, the cooler is configured to distribute weight away from the slot adapted to receive a locking tab via connection of trapezoidal panels to other portions of the cooler. In at least some implementations, the cooler is configured to distribute weight away from the slot adapted to receive a locking tab via connection of trapezoidal panels to lid portions and sidewall portions of the cooler.

In a feature of this aspect, the cooler unfolds to a single flat sheet of corrugated material.

In a feature of this aspect, interior walls of the storage portion include a moisture-resistant coating.

In a feature of this aspect, wherein an exterior surface of the cooler includes a logo printed thereon.

In a feature of this aspect, wherein the one-piece, foldable corrugated cooler comprises corrugated cardboard.

In a feature of this aspect, a leak point of the cooler is defined at an uppermost point of a fold line dividing trapezoidal segments of the cooler.

Another aspect of the present invention relates to a one-piece blank for making a foldable corrugated cooler. The blank includes a bottom panel section configured to define a bottom panel of the cooler when the blank is folded into a use configuration, two side panel sections each configured to define a side panel of the cooler when the blank is folded into a use configuration, two end panel sections each configured to define an end panel of the cooler when the blank is folded into a use configuration, four corner panel sections each configured to define a corner panel of the cooler when the blank is folded into a use configuration, two handle panel sections each configured to define handle panels forming a lid and a two-ply handle of the cooler when the blank is folded into a use configuration, and at least one locking panel portion configured to define at least one two-ply locking panel portion forming a lid and a two-ply handle of the cooler when the blank is folded into a use configuration. The bottom panel section, two side panel sections, two end panel sections, and four corner panel sections are configured to form a storage portion of the cooler when the blank is folded into a use configuration, the storage portion comprising the bottom panel, the two side panels, the two end panels, and the four corner panels. The at least one two-ply locking panel of the cooler is adapted to secure the lid in a closed orientation when the blank is folded into a use configuration, and the at least one two-ply locking panel of the cooler is integral with at least one corner panel of the cooler and at least one handle panel of the cooler when the blank is folded into a use configuration.

In a feature of this aspect, the handle of the cooler includes a handle opening adapted to receive a user's hand there through when the blank is folded into a use configuration. In at least some implementations, the handle further includes a handle support tab when the blank is folded into a use configuration.

In a feature of this aspect, the handle includes at least one two-ply locking tab when the blank is folded into a use configuration, and the at least one two-ply locking panel includes a slot there through adapted to receive and retain the at least one two-ply locking tab when the blank is folded into a use configuration.

In a feature of this aspect, interior walls of the storage portion include a moisture-resistant coating.

In a feature of this aspect, a surface of the blank includes a logo printed thereon.

In a feature of this aspect, the blank comprises corrugated cardboard.

Another aspect of the present invention relates to a method of forming a one-piece, foldable corrugated cooler by folding a blank. The method includes folding end panels and side panels of the blank along fold lines such that the end panels and side panels are perpendicular to a bottom panel of the blank and aligned in a vertical orientation, such folding causing corner panels of the blank to move interior to the end panels and side panels and bend along a fold line such that when the end panels and side panels achieve a vertical orientation, trapezoidal segments of the blank abut one another, and securing an interior surface of one or more of the trapezoidal segments to one or more of the end panels.

Additional aspects and features may be found in the incorporated references. In particular, preferred methods and apparatus for making embodiments of the invention described below are at least generally set forth in such references and are incorporated herein by reference. Indeed, blanks and assembled boxes of the present invention may be made with virgin score lines using such incorporated methods and apparatus.

In addition to the aforementioned aspects and features of the present invention, it should be noted that the present invention further encompasses the various possible combinations and subcombinations of such aspects and features. Thus, for example, any aspect may be combined with an aforementioned feature in accordance with the present invention without requiring any other aspect or feature.

DETAILED DESCRIPTION

Figure 1:
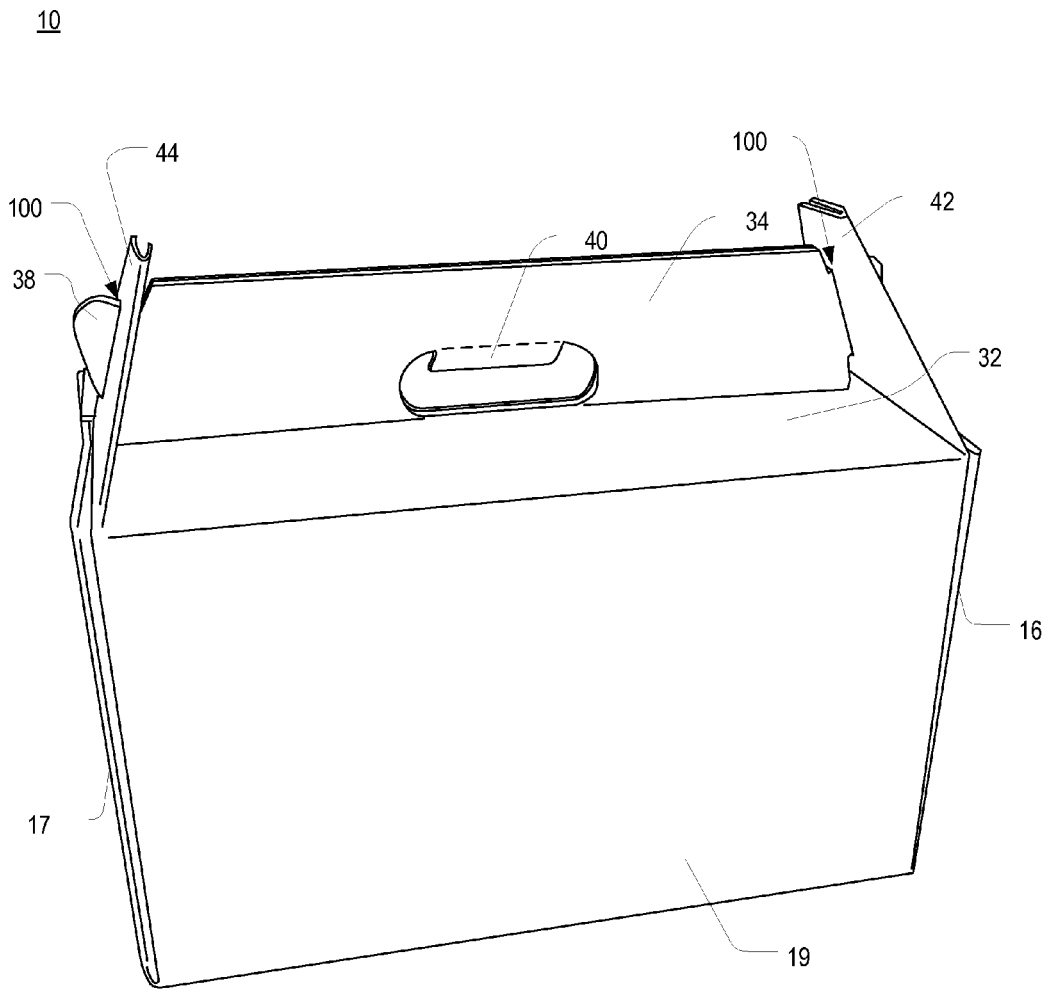
FIG. 1 is a perspective view of a preferred embodiment of a one-piece corrugated cooler in accordance with one or more aspects of the present invention.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

FIG. 1 is a perspective view of a one-piece corrugated cooler 10 in accordance with one or more preferred embodiments of the present invention. The cooler 10 comprises a single sheet of corrugated material 12 folded and formed into a container for the storage of food and beverages. It will be appreciated that the size and dimensions of the single sheet of corrugated material 12 may vary to produce coolers of various shapes and sizes.

Figure 2:
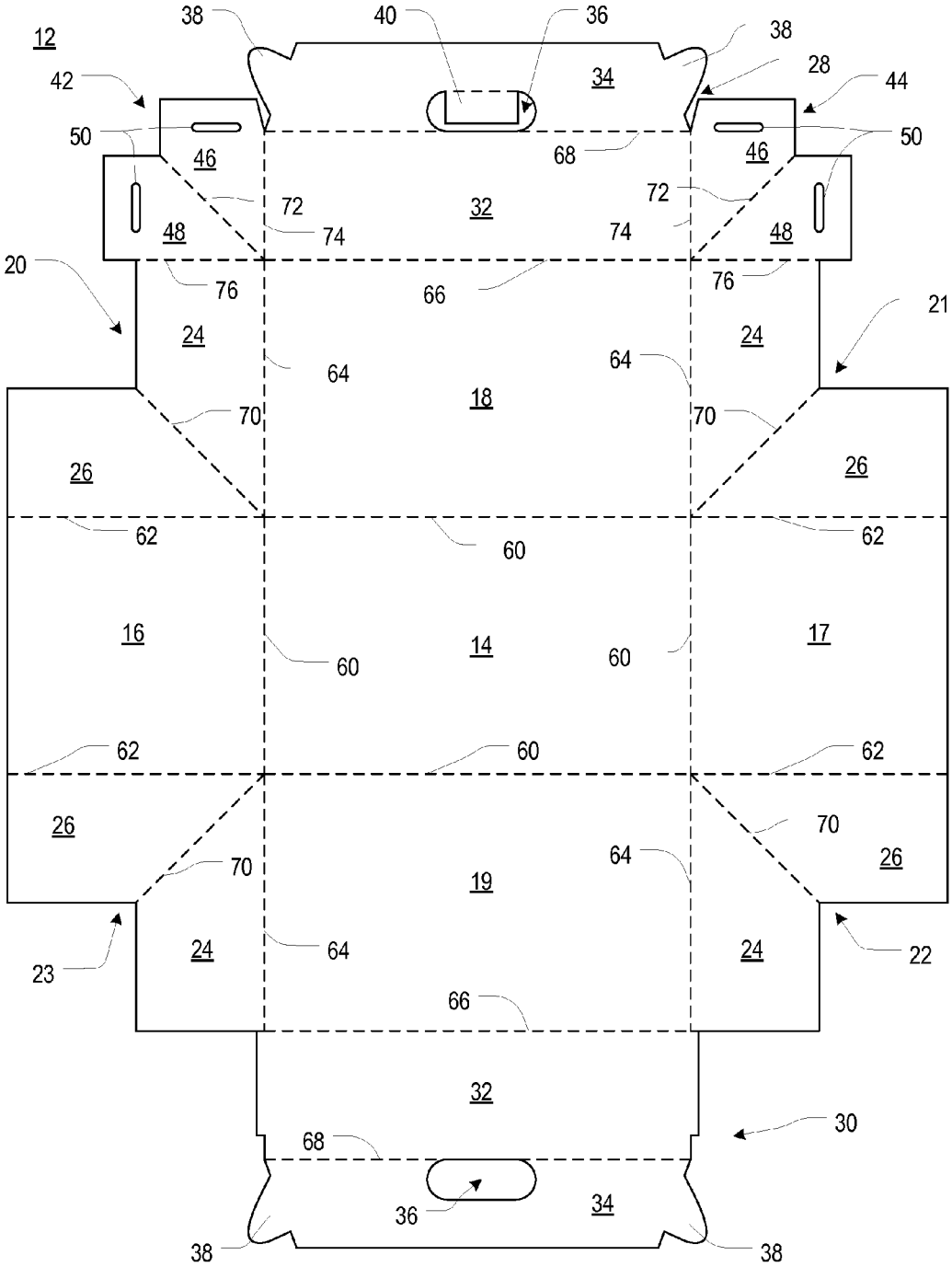
FIG. 2 is a top view of the top surface of a single sheet of corrugated material comprising the cooler of FIG. 1.

FIG. 2 is a top view of the top surface of the single sheet of corrugated material 12 prior to being formed into a cooler 10. The single sheet of corrugated material 12 is formed from a die-cut piece of corrugated sheet material. The single sheet of corrugated material 12 includes a plurality of score lines that divide the single sheet into a plurality of integral panels. For example, with reference to each of two locking panels 42,44 (discussed further below), a score line 74 extends between and divides a handle panel 32 and a respective locking panel 42,44, and similarly a score line 76 extends between and divides a respective corner panel 20,21 and a respective locking panel 42,44. As another example, a score line 66 extends between and divides side panel 18 and a handle panel 32. Furthermore, it should be understood that the top surface of the single sheet of corrugated material 12 shown in FIG. 2 generally becomes the interior surface of the formed cooler 10.

In at least one preferred embodiment, the single sheet of corrugated material 12 is shipped as a flat sheet in order to save space. Furthermore, multiple single sheets can be packaged and shipped together. These flat sheets may be assembled into boxes after shipping is complete.

In at least one preferred embodiment, the single sheet of corrugated material 12 includes a water-resistant coating on the interior surface to prevent the absorption of moisture and loss of structural integrity.

As seen in FIG. 2, the single sheet of corrugated material 12 comprises a bottom panel 14, two end panels 16,17, two side panels 18,19, and four corner panels 20,21,22,23. Each corner panel includes two trapezoidal segments 24,26 separated by a fold line 70. The single sheet of corrugated material 12 further comprises two handle panels 28,30, each handle panel including a lid segment 32 and a handle segment 34 separated by a fold line 68. The handle segment 34 includes a handle opening 36 and two locking tabs 38. One handle opening 36 further includes a handle support tab 40 to improve comfort while gripping the cooler 10. The corrugated material 12 further comprises two locking panels 42,44, the first locking panel 42 being integral with corner panel 20 and lid segment 32, and the second locking panel 44 being integral with corner panel 21 and lid segment 32. Each locking panel 42,44 is divided by fold line 72 into two trapezoidal segments 46,48, each trapezoidal segment 46,48 having an elongated slot 50 adapted to receive locking tab 38 there through.

To form the cooler 10 from the single sheet of corrugated material 12, end panels 16,17 and side panels 18,19 are folded along fold line 60 such that end panels 16,17 and side panels 18,19 are perpendicular to bottom panel 14 and aligned in a vertical orientation. As the end panels 16,17 and side panels 18,19 are folded, corner panels 20,21,22,23 move interior to the end panels 16,17 and side panels 18,19 and bend along fold line 70, such that when end panels 16,17 and side panels 18,19 achieve a vertical orientation, fold lines 62 and 64 are adjacent one another and the exterior surface of trapezoidal segments 24 abuts the exterior surface of trapezoidal segment 26. Finally, the interior surfaces of trapezoidal segments 26 are attached to the end panels 16,17 using an adhesive or other suitable means of attachment. This is illustrated in greater detail in FIGS. 3-5.

Figure 3:
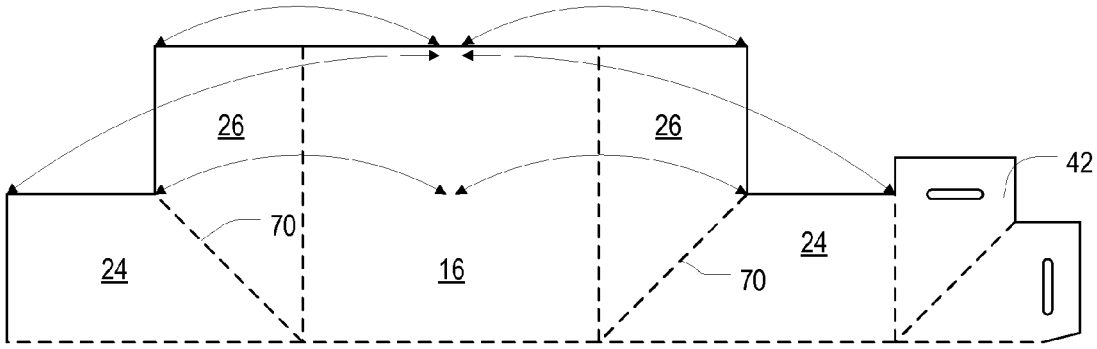
FIG. 3 is an enlarged view of a portion of the single sheet of corrugated material of FIG. 2.

FIG. 3 is an enlarged view of a portion of the single sheet of corrugated material 12 of FIG. 2. FIG. 3 illustrates end panel 16, corner panels 20,23, and locking panel 42 in a flattened configuration. As seen in FIG. 3, six arrows are shown to indicate the movement of various points of the corner panels 18 as the corner panels 18 are folded to assemble the cooler 10.

Figure 4:
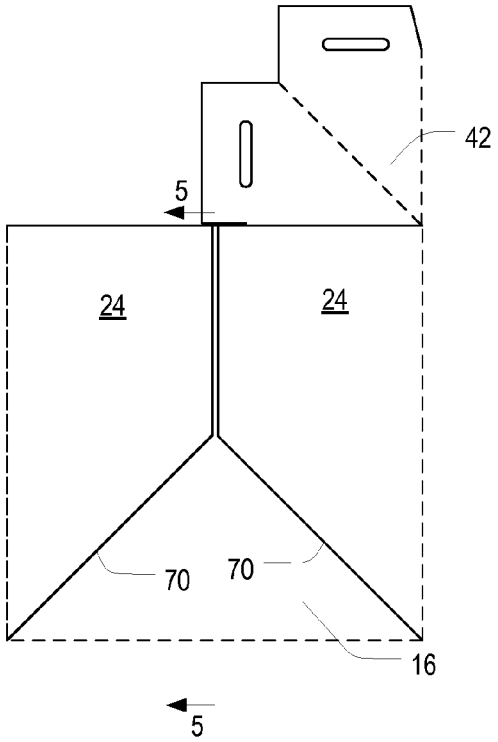
FIG. 4 is view of the portion of the single sheet of corrugated material of FIG. 3 after having been folded.
Figure 5:
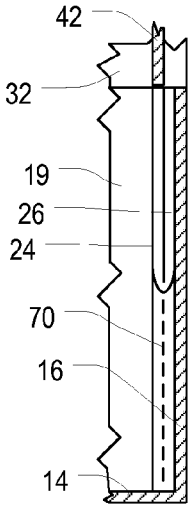
FIG. 5 is a cross-sectional view of the single sheet of corrugated material of FIG. 4 taken along line 5-5.

FIG. 4 is a view of the portion of the corrugated material 12 of FIG. 3 after the corner panels 20,21,22,23 have been folded to form the cooler 10. FIG. 5 is a cross-sectional view of FIG. 4 taken along line 5-5. As each corner panel 20,21,22,23 is folded, trapezoidal segment 26 is folded such that the inner surface of trapezoidal segment 26 abuts the inner surface of end panel 16. Furthermore, trapezoidal segment 24 is folded along fold line 70 such that the outer surface of trapezoidal segment 24 abuts the outer surface of trapezoidal segment 26. The final result is seen in FIGS. 4 and 5, showing trapezoidal segment 26 hidden behind trapezoidal segment 24.

Each handle panels 28,30 is divided along fold line 68 into a lid segment 32 and a handle segment 34. Each handle segment 34 includes a handle opening 36 disposed there through. The handle panels 28,30 approximately mirror and align with one another, such that the handle is essentially two-ply to provide greater support and strength. To close the cooler 10, the lid segments 32 are folded over the opening of the cooler into a horizontal orientation such that the opening of the cooler 10 is concealed by the lid segments 32. The handle segments 34 are folded perpendicular to the lid segments 32 into a vertical orientation and aligned.

Each locking panel 42,44 is divided along fold line 72 into two trapezoidal segments 46,48, each trapezoidal segment 46,48 including an elongated slot adapted to receive the locking tabs on the handle segments 34 of each handle panel 28,30. The trapezoidal segments 46,48 are mirror images of each other and, when folded along fold line 72, align with one another to form a two-ply locking panel 42,44. The two-ply locking panel 42,44 provides greater reinforcement in keeping the cooler 10 closed and stable. Such a two-ply locking panel increases the weight capacity of the cooler 10.

To secure the closed handle panels 28,30 in place, as seen in FIG. 1, the two-ply locking panel 42,44 is folded toward the locking tab 38 and the locking tab is inserted through the now two-ply slot 50.

While in a locked configuration, the cooler 10 can be carried via the handle opening 36. Due to the configuration of the panels described hereinabove, the weight in the cooler 10 is more evenly distributed to reduce the risk of structural failure. For example, with reference to FIGS. 1 and 2, the connection of the trapezoidal segment 48 of each locking panel 42,44 to trapezoidal segment 24 and the connection of the trapezoidal segment 46 of each locking panel 42,44 to lid segment 32 distributes weight such that as much stress is not placed on stress points 100 when each set of trapezoidal segments 46,48 is aligned with one another to form a two-ply locking panel and secured over a respective locking tab such that each respective locking tab is received in the defined elongated slot of that respective two-ply locking panel.

Figure 6:
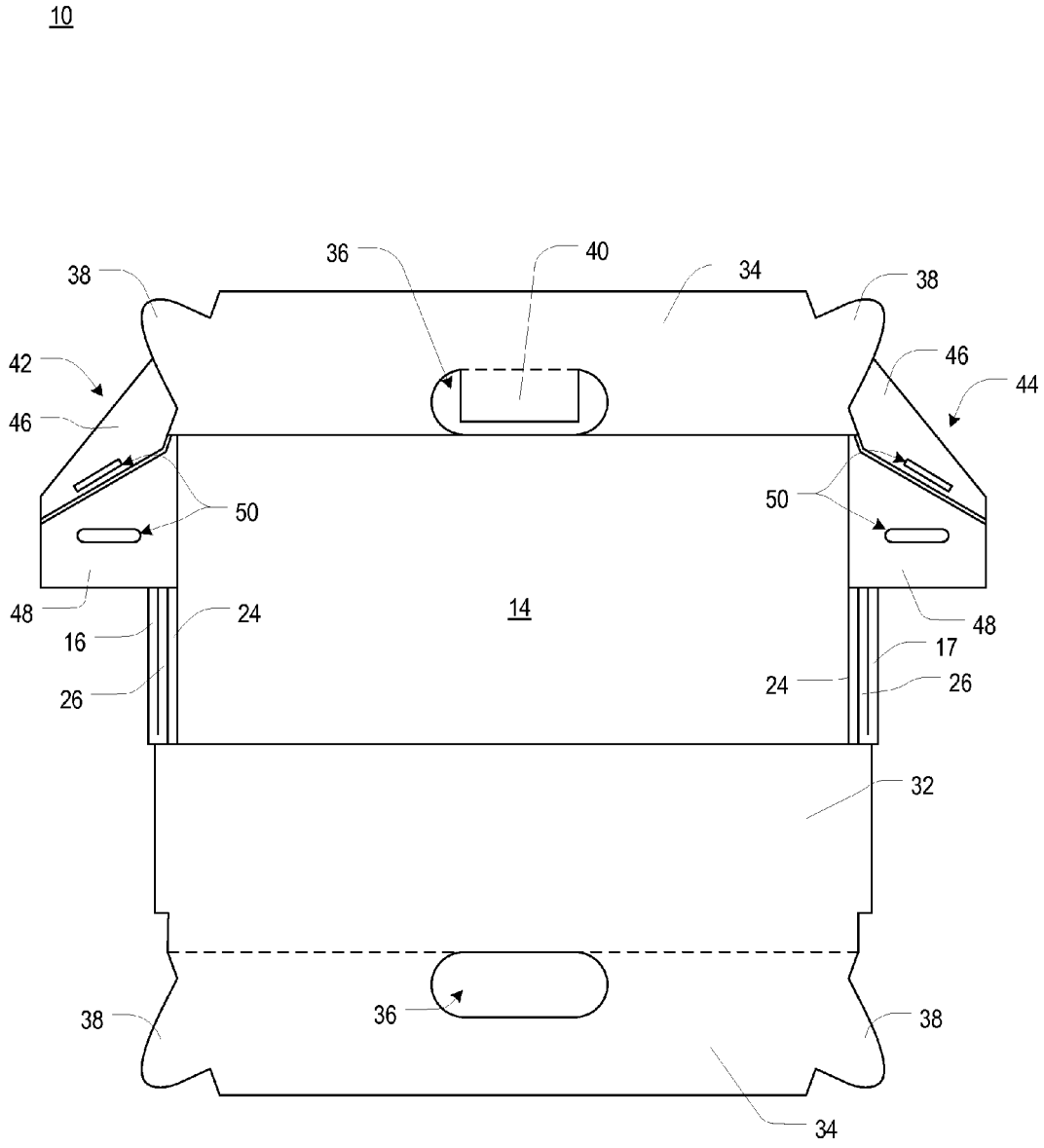
FIG. 6 is top plan view of the cooler of FIG. 1.
Figure 7:
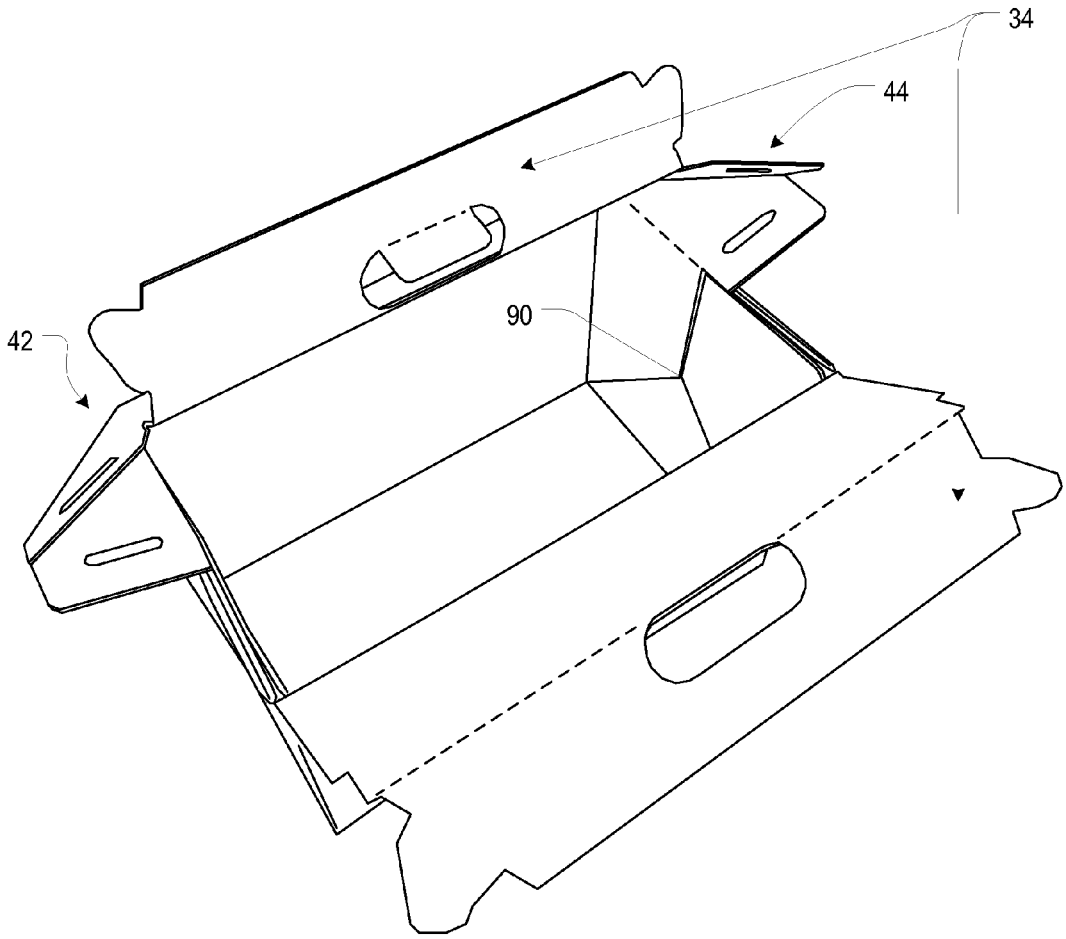
FIGS. 7 and 8 are top perspective views of the cooler of FIG. 1.
Figure 8:
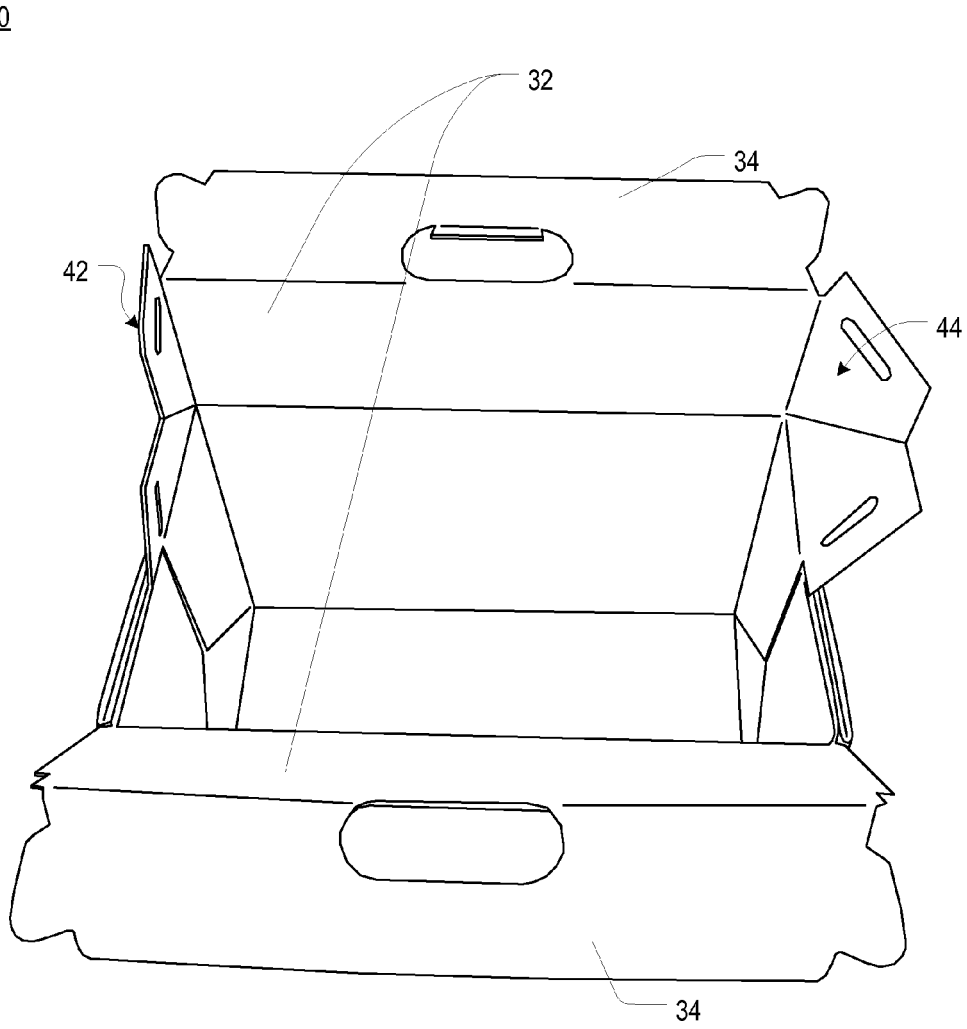

FIGS. 6-8 are top views of the cooler of FIG. 1 with the lid in an open position exposing the interior of the cooler 10. Furthermore, FIG. 7 illustrates the "leak point" 90 of the cooler 10 at the uppermost point of fold line 70 dividing the trapezoidal segments 24,26. The leak point 90 is defined as the lowest point in the interior of the cooler 10 providing access to the exterior of the cooler 10. Due to the one-piece, foldable-paneled construction of the cooler 10, the cooler 10 benefits from a relatively high leak point 90.

With reference now to U.S. patent application publication no. US 2012/0234715, FIGS. 9-14 of this incorporated patent application publication are photographs of a preferred embodiment of a one-piece corrugated cooler in accordance with one or more aspects of the present invention. Moreover, FIG. 15 of the incorporated '715 patent application publication illustrate additional preferred embodiments of a one-piece corrugated cooler in accordance with one or more aspects of the present invention; FIGS. 16-17 of the incorporated '715 patent application publication illustrate additional preferred embodiments of one-piece corrugated coolers in accordance with one or more aspects of the present invention; and FIG. 18 of the incorporated '715 patent application publication illustrates an exemplary specification that might be used to create the coolers illustrated in FIGS. 16-17 thereof.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A one-piece blank for making a foldable corrugated cooler, the blank comprising:

(a) a bottom panel section configured to define a bottom panel of the cooler when the blank is folded into a use configuration;

(b) two side panel sections each configured to define a side panel of the cooler when the blank is folded into the use configuration;

(c) two end panel sections each configured to define an end panel of the cooler when the blank is folded into the use configuration;

(d) four corner panel sections each configured to define a corner panel of the cooler when the blank is folded into the use configuration;

(e) a handle panel section configured to define a handle panel comprising a lid segment and a handle segment, the handle segment comprising a locking tab, when the blank is folded into the use configuration; and (f) a locking panel section configured to define a locking panel adapted to receive the locking tab of the handle segment for locking engagement of the handle segment when the blank is folded into the use configuration;

(g) wherein a score line extends between and divides the locking panel and one of the four corner panels when the blank is folded into the use configuration.

2. The one-piece blank of claim 1, wherein no score line extends between and divides the locking panel and either of the two end panels when the blank is folded into the use configuration.

3. The one-piece blank of claim 1, further comprising a second handle panel section configured to define a second handle panel comprising a second lid segment, the lid segments collectively defining a lid of the cooler when the blank is folded into the use configuration.

4. The one-piece blank of claim 3, wherein the handle segment comprises a second locking tab, and wherein the blank further comprises a second locking panel section configured to define a second locking panel adapted to receive the second locking tab of the handle segment for locking engagement of the handle segment when the blank is folded into the use configuration.

5. The one-piece blank of claim 1, wherein a surface of the blank configured to define interior walls of the cooler when the blank is folded into the use configuration comprises a moisture-resistant coating.

6. The one-piece blank of claim 1, wherein a surface of the blank configured to define a surface of the outside of the cooler when the blank is folded into the use configuration comprises a logo printed thereon for viewing when the blank is folded into the use configuration.

7. The one-piece blank of claim 1, wherein the blank comprises corrugated cardboard.

8. The one-piece blank of claim 1, wherein, when the blank is folded into the use configuration, the locking panel is integral with one of the four corner panels and at least one handle panel, with a score line extending between and dividing the locking panel and the corner panel with which the locking panel is integral, and with a score line extending between and dividing the locking panel and the handle panel.

9. The one-piece, foldable corrugated cooler of claim 1, wherein each locking panel comprises trapezoidal segments divided by a fold line when the blank is folded into the use configuration.

10. The one-piece, foldable corrugated cooler of claim 9, wherein a leak point of the cooler is defined at an uppermost point of the fold line dividing the trapezoidal segments of a locking panel.

11. A single sheet of corrugated material having fold lines defining a blank for making a foldable corrugated cooler, the blank comprising:

(a) a bottom panel section;

(b) two end panel sections;

(c) two side panel sections;

(d) four corner panel sections;

(e) two handle panel sections, each handle panel section including a lid segment and a handle segment separated by a fold line, the handle segment including a handle opening and two locking tabs; and (f) two locking panel sections, a first locking panel section being integral with a first corner panel section with a score line extending there between, and being integral with a lid segment of a first handle panel section with a score line extending there between, and a second locking panel section being integral with a second corner panel with a score line extending there between, and being integral with the lid segment of the first handle panel section with a score line extending there between.

12. The single sheet of corrugated material having fold lines defining a blank for making a foldable corrugated cooler in accordance with claim 11, wherein, when the blank is folded into the use configuration, each locking panel section is divided by a respective fold line into two trapezoidal segments.

13. The single sheet of corrugated material having fold lines defining a blank for making a foldable corrugated cooler in accordance with claim 12, wherein each trapezoidal segment has an elongated slot adapted to receive a locking tab there through when the blank is folded into the use configuration.

14. The single sheet of corrugated material having fold lines defining a blank for making a foldable corrugated cooler in accordance with claim 12, wherein a leak point of the cooler is defined at an uppermost point of a fold line dividing trapezoidal segments of the cooler when the blank is folded into the use configuration.

15. A one-piece blank for making a foldable corrugated cooler, the blank comprising:

(a) a bottom panel section configured to define a bottom panel of the cooler when the blank is folded into a use configuration;

(b) two side panel sections each configured to define a side panel of the cooler when the blank is folded into the use configuration;

(c) two end panel sections each configured to define an end panel of the cooler when the blank is folded into the use configuration;

(d) four corner panel sections each configured to define a corner panel of the cooler when the blank is folded into the use configuration;

(e) two handle panel sections each configured to define a handle panel comprising a lid segment and a handle segment of the cooler when the blank is folded into the use configuration; and (f) two locking panel sections, each configured to define a locking panel adapted to secure the lid segment in a closed orientation when the blank is folded into the use configuration;

(g) wherein each of the two locking panels of the cooler is integral with a respective corner panel of the cooler and a handle panel of the cooler when the blank is folded into a use configuration, with a score line extending between and dividing the locking panel and the respective corner panel, and with a score line extending between and dividing the locking panel and the handle panel.

16. The one-piece blank for making a foldable corrugated cooler of claim 15, wherein no score line extends between and divides a locking panel section and an end panel section.

17. The one-piece blank of claim 15, wherein the handle segment includes two locking tabs, and wherein the each locking panel includes a slot adapted to receive there through and retain a locking tab when the blank is folded into the use configuration.

18. The one-piece blank of claim 15 wherein, when the blank is folded into the use configuration, each locking panel is divided by a respective fold line into two trapezoidal segments.

19. The one-piece blank of claim 18, wherein each trapezoidal segment has an elongated slot adapted to receive a locking tab there through when the blank is folded into the use configuration.

20. The one-piece blank of claim 18, wherein a leak point of the cooler is defined at an uppermost point of a fold line dividing trapezoidal segments of the cooler when the blank is folded into the use configuration.

* * * * *